US009328902B2

(12) United States Patent
Eckert et al.

(10) Patent No.: US 9,328,902 B2
(45) Date of Patent: May 3, 2016

(54) REFLECTOR FOR A LIGHTING DEVICE AND LIGHTING DEVICE

(75) Inventors: Klaus Eckert, Herbrechtingen (DE); Moritz Engl, Regensburg (DE)

(73) Assignee: OSRAM GmbH, Munich (DE)

( * ) Notice: Subject to any disclaimer, the term of this patent is extended or adjusted under 35 U.S.C. 154(b) by 115 days.

(21) Appl. No.: 13/511,048

(22) PCT Filed: Nov. 12, 2010

(86) PCT No.: PCT/EP2010/067335

§ 371 (c)(1),
(2), (4) Date: May 21, 2012

(87) PCT Pub. No.: WO2011/061120

PCT Pub. Date: May 26, 2011

(65) Prior Publication Data

US 2012/0281418 A1 Nov. 8, 2012

(30) Foreign Application Priority Data

Nov. 19, 2009 (DE) ..... 10 2009 053 957

(51) Int. Cl.

| | |
|---|---|
| ***F21V 7/00*** | (2006.01) |
| ***F21V 17/02*** | (2006.01) |
| ***F21V 7/04*** | (2006.01) |
| *F21Y 101/02* | (2006.01) |
| *F21V 7/06* | (2006.01) |
| *F21V 17/00* | (2006.01) |
| *F21V 17/16* | (2006.01) |

(52) U.S. Cl.

CPC ..... *F21V 17/02* (2013.01); *F21V 7/0083* (2013.01); *F21V 7/048* (2013.01); *F21V 7/06* (2013.01); *F21V 17/005* (2013.01); *F21V 17/164* (2013.01); *F21Y 2101/02* (2013.01)

(58) Field of Classification Search

CPC ..... F21V 7/00; F21V 7/0025; F21V 7/0033
USPC ..... 362/245, 296.01, 297, 302, 306, 514, 362/516

See application file for complete search history.

(56) References Cited

U.S. PATENT DOCUMENTS

| | | | | |
|---|---|---|---|---|
| 2,104,437 | A * | 1/1938 | Peters | F21S 48/1208 362/374 |
| 4,343,031 | A * | 8/1982 | Liebegott | B60Q 1/0683 362/289 |
| 4,414,614 | A * | 11/1983 | McMahan | B60Q 1/0441 362/269 |
| 4,491,901 | A * | 1/1985 | Sigety, Jr. | B60Q 1/0683 313/113 |
| 4,584,634 | A * | 4/1986 | Sigety, Jr. | B60Q 1/0683 362/275 |
| 4,965,703 | A * | 10/1990 | Whalen | 362/549 |
| 6,402,347 | B1 * | 6/2002 | Maas et al. | 362/294 |
| 6,431,723 | B1 * | 8/2002 | Schubert et al. | 362/147 |

(Continued)

FOREIGN PATENT DOCUMENTS

| | | |
|---|---|---|
| CN | 2267494 | 11/1997 |
| CN | 1702370 | 11/2005 |

(Continued)

*Primary Examiner* — Evan Dzierzynski
*Assistant Examiner* — Tsion Tumebo
(74) *Attorney, Agent, or Firm* — Cozen O'Connor

(57) ABSTRACT

A reflector (1; 31; 41) for a lighting device comprising: (13; 61; 62), at least one rear cutout (6) for a light source (20; 47; 56) in each case and at least one front-side reflector opening (8), wherein at least one spring element (10; 34; 45) is incorporated into the reflector (1; 31; 41).

7 Claims, 6 Drawing Sheets

(56) References Cited

U.S. PATENT DOCUMENTS

| | | | | |
|---|---|---|---|---|
| 6,478,454 | B1 * | 11/2002 | Jaffari et al. | 362/307 |
| 6,953,264 | B2 * | 10/2005 | Ter-Hovhannisian | 362/241 |
| 7,722,208 | B1 * | 5/2010 | Dupre et al. | 362/147 |
| 7,819,562 | B2 * | 10/2010 | Freeman | H01J 5/60 362/296.01 |
| 7,938,559 | B2 * | 5/2011 | Angelini et al. | 362/241 |
| 8,197,101 | B2 * | 6/2012 | Kokado et al. | 362/296.07 |
| 8,474,999 | B2 * | 7/2013 | Ou et al. | 362/249.02 |
| 2004/0184269 | A1 * | 9/2004 | Walton | 362/260 |
| 2005/0036307 | A1 | 2/2005 | Wang | |
| 2006/0250789 | A1 * | 11/2006 | Coushaine | 362/157 |
| 2006/0262544 | A1 * | 11/2006 | Piepgras | F21K 9/00 362/373 |
| 2006/0291206 | A1 * | 12/2006 | Angelini et al. | 362/244 |
| 2007/0230177 | A1 * | 10/2007 | Suzuki | 362/257 |

FOREIGN PATENT DOCUMENTS

| | | | |
|---|---|---|---|
| DE | 10 2004 004 778 | | 9/2005 |
| JP | 09-270201 | | 10/1997 |
| JP | 11-501148 | | 1/1999 |
| JP | 3-098589 | | 10/2003 |
| JP | 2004-355973 | | 12/2004 |
| JP | 2008-543000 | | 11/2008 |
| JP | 2008-310984 | | 12/2008 |
| WO | WO 2006/118656 | | 11/2006 |
| WO | WO 2006/127785 | | 11/2006 |
| WO | WO 2008089324 | A2 * | 7/2008 |
| WO | WO 2009/051128 | | 4/2009 |

* cited by examiner

REFLECTOR FOR A LIGHTING DEVICE AND LIGHTING DEVICE

RELATED APPLICATIONS

This application is a U.S. National Phase Application under 35 USC 371 of International Application PCT/EP2010/067335 filed Nov. 12, 2010.

This application claims the priority of German application no. 10 2009 053 957.3 filed Nov. 19, 2009, the entire content of which is hereby incorporated by reference.

FIELD OF THE INVENTION

The invention relates to a reflector for a lighting device, having at least one cutout on the rear side thereof for a light source and at least one reflector opening on the front side thereof.

BACKGROUND OF THE INVENTION

Reflectors have hitherto typically been glued or clamped in place for mounting in LED lamps. This generally poses the problem that mechanical tolerances have to be compensated. This problem has hitherto been solved by using one or more compensating elements such as compression springs.

DE 10 2004 004 778 A1 relates to an LED lighting module having one or more LED components and an optical device for beam shaping which is disposed downstream of the LED component in the radiation direction thereof. For each LED component, the optical device has a radiation-focusing optical element which, viewed from the LED component, is followed by a radiation-widening optical element. The LED lighting module likewise contains a beam-shaping optical device for such an LED lighting module. In the case of the latter, a radiation-permeable plate is provided which has radiation-widening and radiation-mixing structures on a first main surface. On a second main surface facing away from the first main surface there is disposed at least one radiation-focusing optical element which is capable of focusing radiation received from an LED component before it passes through the radiation-permeable plate onto a smaller aperture angle of the radiation compared to the angle of radiation of the LED component. The radiation-permeable plate with the radiation-widening and radiation-mixing structures and the radiation-focusing optical element are altogether implemented in one piece from a radiation-permeable plastic.

SUMMARY OF THE INVENTION

One object of the present invention is to provide a reflector for a lighting unit, said reflector being particularly inexpensive to manufacture and allowing compact and effective tolerance compensation.

This object is achieved by a reflector for a lighting unit, the reflector having at least one cutout on the rear side thereof for a light source and at least one reflector opening on the front side thereof.

A reflector can be understood in particular as meaning a generally beam-shaping element which can be implemented in particular as a specularly reflecting element or as a diffusely reflecting element.

In general, at least some of the light emitted by a respective light source can be redirected by the reflector.

Said light source can be disposed below i.e. spaced back from the associated cutout. At least some of the light radiated by the light source is then incident through the cutout, can then be reflected (possibly multiply) by the reflector and then exits through the reflector opening. In particular, for example, light from the light source incident directly upward i.e. vertically or at a slight angle thereto through the cutout can exit through the reflector opening without reflection.

The at least one rear cutout can be provided in a rear reflector base.

Alternatively, the light source can be at least partially inserted into the cutout. The light emitted thereby can be completely or partially reflected by the reflector and subsequently exit through the reflector opening.

Also incorporated in the reflector is at least one spring element. Said integral spring element enables contact pressure to be applied to the reflector for highly accurate tolerance compensation. This eliminates mispositioning of a separate spring element, e.g. due to tilting. The reflector with integral spring element is also less expensive to implement than a conventional reflector having a separate spring element. At least one component can be saved. A particularly compact design is also made possible.

The spring element preferably acts essentially parallel to the longitudinal axis of the reflector and/or parallel to a main radiation direction of the lighting device and/or at least one light source of the lighting device.

The reflector can have a base body made of metal or plastic. The reflector can be e.g. an injection molded plastic base body whose reflector wall or walls have been provided, in particular subsequently, with a reflecting surface, e.g. with a reflective foil or a reflective coating.

The at least one spring element can in particular constitute an integral part of the reflector.

In one embodiment, the at least one spring element can project forward. "Forward" can be understood in particular as meaning a region above i.e. in front of the at least one front-side reflector opening. "Forward" can also in particular be understood as meaning a region which is above the at least one front-side reflector opening with respect to a longitudinal axis of the reflector. Also the light radiated by the at least one reflector is radiated "forward" into a corresponding front half space. The longitudinal axis of the reflector can in particular also correspond to an axis of symmetry and/or an optical axis. By means of the at least one forward projecting spring element, the reflector can be pressed from the front in the rearward direction, wherein a manufacturing tolerance can be compensated via a change in spring deflection of the at least one spring element. Particularly in the case of more than one spring element, in particular in the case of three or more spring elements, tilting of the reflector can thus also be tolerance-compensated in a simple manner.

In another embodiment, the at least one spring element is implemented as an obliquely forward facing, unilaterally fixed bar. The bar is in particular elastically swivelable about its fixing. It can be implemented in a particularly simple and compact manner. The spring element can also be regarded as a unilateral lever. Its free end can then be used as an placement point for an element, e.g. a cover plate, pressing on the reflector on the front side.

In an alternative embodiment, the at least one spring element is implemented as a bilaterally fixed bar. The forward projection can be achieved by bending up a region between the two fixed ends, e.g. in the form of an inverted "U".

In a particular embodiment, the reflector has at least one rearward projecting positioning element, in particular a spacer. By means of the at least one spring element, the reflector can be securely fixed even if there is a tolerance-affected gap between the front side of the reflector and the element pressing on the reflector at the front. In particular, by means of the at least one positioning element a clearance to the at least one light source can be precisely maintained, thereby allowing accurately reproducible beam guidance.

In an alternative embodiment, the at least one spring element is incorporated in a respective support element of the reflector. A support element can in particular be oriented in a rearward direction and accordingly support the reflector on the rear side. By means of the at least one integral spring element, when the reflector is pressed together, e.g. when a cover plate is put on, the reflector is pressed forward, e.g. onto the cover plate. The reflector can thus, for example, be mounted without spacers, i.e. in a "floating" manner relative to the at least one light source.

In a particular embodiment, the reflector is of at least two-part design comprising a reflector holder and at least one reflector insert, wherein the at least one reflector insert contains at least one of the cutouts and at least one of the front-side reflector openings in each case. The at least one reflector insert contains in particular the reflecting surfaces. The at least one reflector insert can be inserted into the reflector holder from the front, the at least one spring element being incorporated into a respective support element of the reflector holder. In this embodiment, the at least one spring element can in particular press the reflector against a cover plate, thereby in turn pressing the at least one reflector insert into the reflector holder and thus retaining it there.

In general, the at least one reflector insert can contain just one of the recesses and just one of the front-side reflector openings. In particular, a plurality of reflector inserts can have just one of the cutouts and just one of the front-side reflector openings in each case. As an alternative, the at least one reflector insert can contain a plurality of the cutouts and just one of the front-side reflector openings, e.g. in the case of intermeshing reflector surfaces.

In general, the reflector can be implemented in one piece or as a plurality of pieces. The one-piece design (including the at least one spring element) has the advantage that manufacturing and assembly can be carried out inexpensively, e.g. by an injection molding process. The injection molding can be performed e.g. as a single-stage or multi-stage process. Also, mismatches of the individual functional components (reflector holder, reflector recess(es), spring element(s), etc.) no longer occur. Moreover, the one-piece reflector possesses high stability and accuracy of fit.

The object is also achieved by a lighting device having at least one such reflector. By means of the integral spring element, pressure can be applied to the reflector, e.g. by means of a translucent cover plate, with highly accurate tolerance compensation. Mispositioning, e.g. due to tilting of a separate spring element, is eliminated. The reflector with integral spring element is also less expensive to implement than a conventional reflector having a separate spring element. At least one component can be saved. A particularly compact design is also made possible.

In a further development, the at least one front-side reflector opening is covered using a covering element pressing on the reflector.

In another further development, particularly if the reflector has at least one rearward projecting spacer, the at least one light source is disposed on a light source carrier and the at least one spacer is seated on the light source carrier. Thus the at least one spring element can hold the reflector securely and in a defined position relative to the at least one light source.

In an additional further development, particularly if the at least one spring element is incorporated into a respective support element of the reflector, the at least one light source is disposed on a light source carrier and the light source carrier and the respective support element are disposed on a housing of the lighting device. As a result, the light sources and the reflector can be mounted independently and without direct mechanical contact on the housing. In particular, this provides a simple means of floating positioning of the reflector above the at least one light source.

The at least one light source preferably comprises at least one light-emitting diode. If a plurality of light-emitting diodes are present, these can illuminate in the same color or in different colors. A color can be monochromatic (e.g. red, green, blue, etc.) or multichromatic (e.g. white). The light radiated by the at least one light-emitting diode can be infrared light (IR-LED) or ultraviolet light (UV-LED). A plurality of light-emitting diodes can produce a mixed light, e.g. a white mixed light. The at least one light-emitting diode can contain at least one wavelength-converting phosphor (conversion LED). The at least one light-emitting diode can be present in the form of at least one individually packaged light-emitting diode or in the form at least one LED chip. A plurality of LED chips can be mounted on a common substrate ("submount"). The at least one light-emitting diode can be equipped with at least one separate and/or common optical system for beam guidance, e.g. at least one Fresnel lens, collimator, etc. Instead of or in addition to inorganic light-emitting diodes, e.g. based on InGaN or AlInGaP, organic LEDs (OLEDs, e.g. polymer OLEDs) can also generally be used. Diode lasers, for example, can also be used. Alternatively, the at least one light source can have e.g. at least one diode laser.

LED light sources are characterized by, among other things, high efficiency, long service life, a rapid response time and a comparatively low sensitivity to impacts and vibrations. In addition, LED light sources are suitable for installation in optical systems, particularly reflectors. For this reason LED light sources can be used in lighting units in which until now incandescent or discharge lamps have often been used, particularly in lights for general lighting but also in special lighting applications such as airfield lighting for which hitherto halogen reflector lamps have predominantly conventionally been used to date.

However, the invention is not limited to semiconductor lighting elements (light-emitting diodes, diode lasers, etc.), by can also encompass other kinds of light sources, e.g. miniature incandescent lamps or discharge lamps.

BRIEF DESCRIPTION OF THE DRAWINGS

Exemplary embodiments of the invention will now be described in greater detail with reference to the following schematic drawings in which, for the sake of clarity, elements that are identical or have an identical effect are provided with the same reference characters.

DETAILED DESCRIPTION OF THE DRAWINGS

Figure 1:
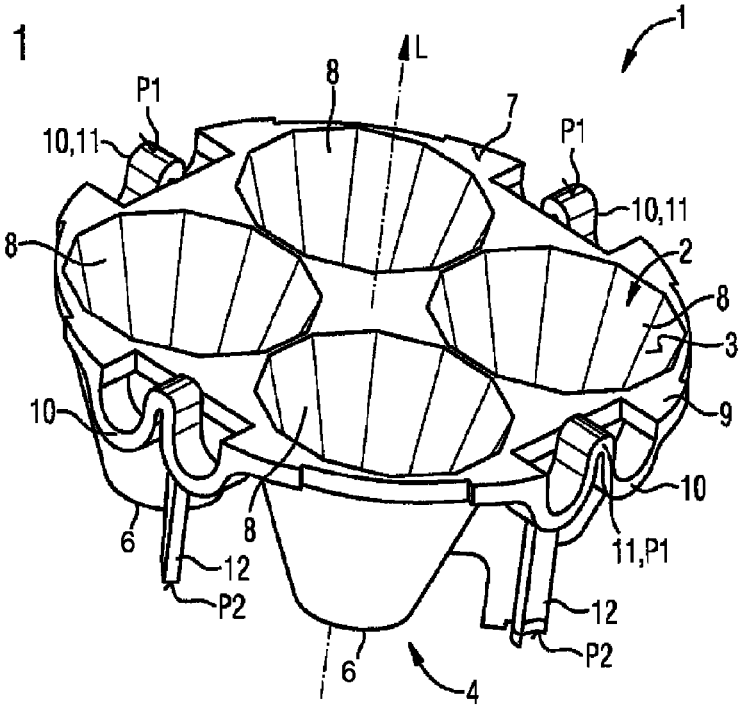
FIG. 1 shows an oblique top or front view of a reflector according to a first exemplary embodiment.

FIG. 1 shows an oblique top view of a one-piece reflector 1 according to a first exemplary embodiment. The reflector 1 may have been manufactured e.g. by a plastic injection molding process. The reflector 1 has four cup-shaped or conical reflector recesses 2 disposed in an axially symmetric manner about a longitudinal axis L and having specularly or diffusely reflecting inner walls 3. The inner walls 3 can be e.g. parabolic, hyperbolic or shaped as a freeform surface. On their rear sides, which form part of a reflector base 4, the reflector recesses 2 are each provided with a central cutout 6. Each of the reflector recesses 2 has a front reflector opening 8 on the front side 7 of the reflector 1.

Light emitted by a light source disposed therebelow can be incident through the respective rear cutout 6, or a light source can extend into the cutout 6 from behind or below. The light emitted by the light source can accordingly be at least partially reflected by the reflector recesses 2 and then exit at the associated reflector opening 8. In some cases, light emitted perpendicularly by the light source (running parallel to the longitudinal axis L) or light whose angle with respect to the longitudinal axis L is less than or equal to an aperture angle of the reflector recess 2 can exit through the reflector opening 8 without reflection from the reflector recess 2.

In an upper edge 9 of the reflector 1 there are here incorporated four spring elements 10 disposed axially symmetrically with respect to the longitudinal axis L. The spring elements 10 each project out forward (in the direction of the longitudinal axis L) above the rest of the reflector 1 and therefore constitute the uppermost or farthest forward points P1 of the reflector 1. The spring elements 10 are in each case implemented as bilaterally fixed bars which are formed centrally into the shape of an inverted "U" 11. The base of the "U" 11 therefore constitutes the frontmost point P1 of the reflector 1, although this is not a mandatory feature.

The reflector 1 also has four rearward or backward projecting spacers 12 disposed axially symmetrically with respect to the longitudinal axis L. The spacers 12 define the lowest or most rearwardly disposed point P2 of the reflector 1.

Figure 2:
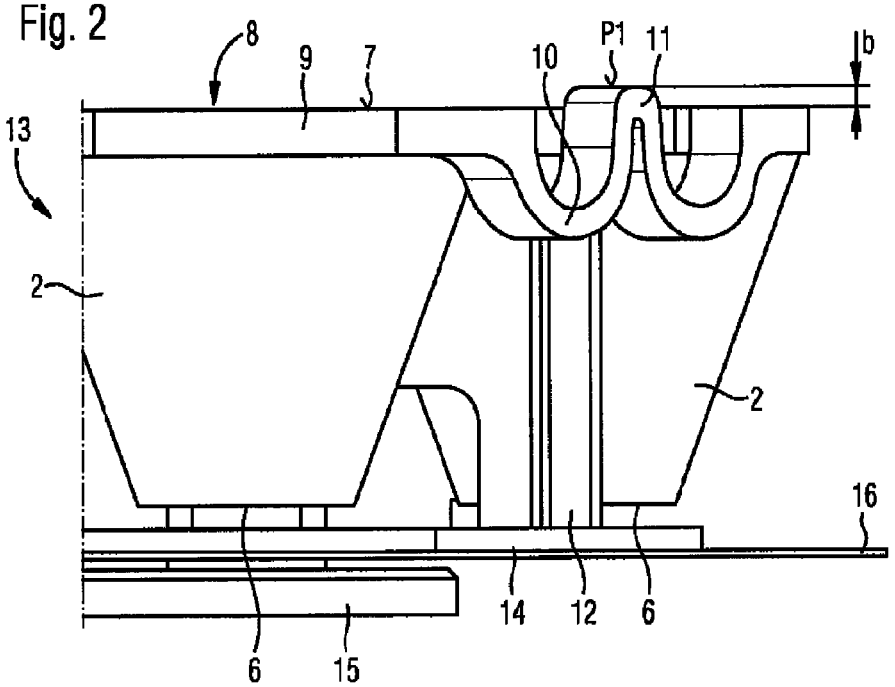
FIG. 2 shows a side view of part of a lighting device having the reflector according to the first exemplary embodiment.

FIG. 2 shows a side view of part of a lighting device 13 having the reflector 1 according to the first exemplary embodiment. The reflector 1 is placed supported by the spacers 12 on an LED carrier 14 (e.g. a circuit board) on which four light-emitting diodes (not shown) are also mounted. The LED carrier 14 in turn rests on a housing 16. A cable bushing 15 for electrical connection of the carrier plate e.g. to a remotely disposed driver (not shown) projects through the LED carrier 14. The respective spring element 10 projects above the front side 7 by a height b.

Figure 3:
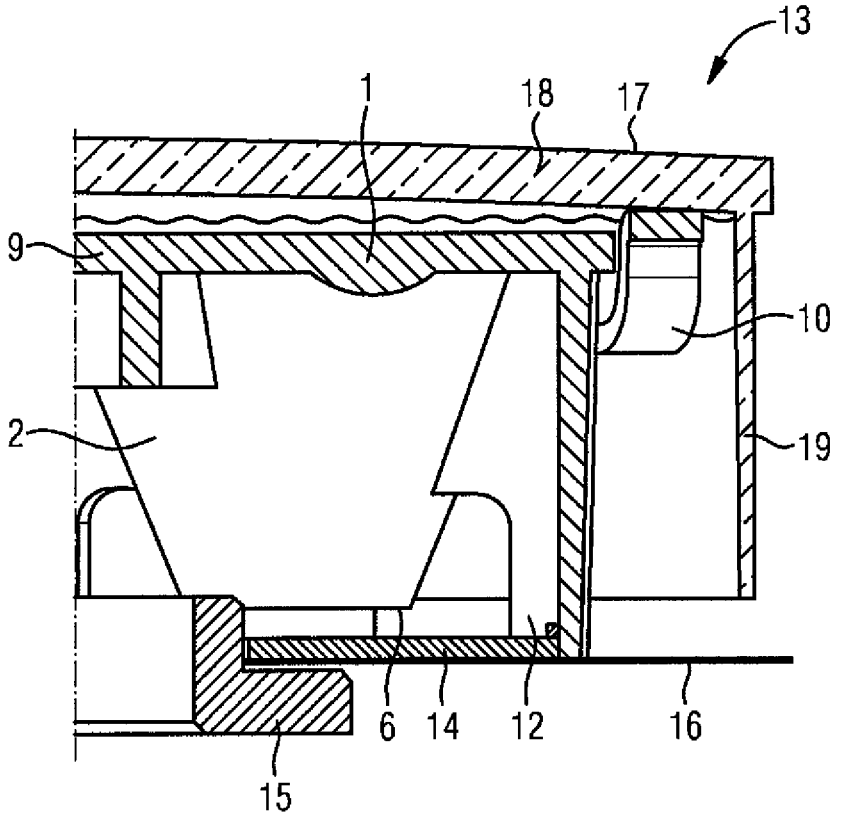
FIG. 3 shows a side view of another part of the lighting device having the reflector according to the first exemplary embodiment.

FIG. 3 shows a side view of another part of the lighting device 13, wherein a translucent plastic cover 17 is now placed on the reflector 1 from the front or above. The translucent cover 17 has an essentially disk-shaped or plate-shaped upper side 18 and a laterally circumferential edge 19, i.e. is here essentially shaped like an inverted cup.

By pushing the upper side 18 of the cover 17 onto the reflector 1, the spring elements 10 are forced downward, thereby pressing the reflector 1 onto the carrier 14, wherein a clearance between the respective rear cutout 6 and the LED carrier 14 is determined by the spacer 12. The spacers 12 also delimit the LED carrier 14 laterally, so that they are used as general positioning elements which here also prevent lateral displacement of the reflector 1 relative to the LED carrier 14. The spring elements 10 provide a simple and compact means of compensating any placement tolerance of the cover 17, namely up to a projection height b.

Figure 4:
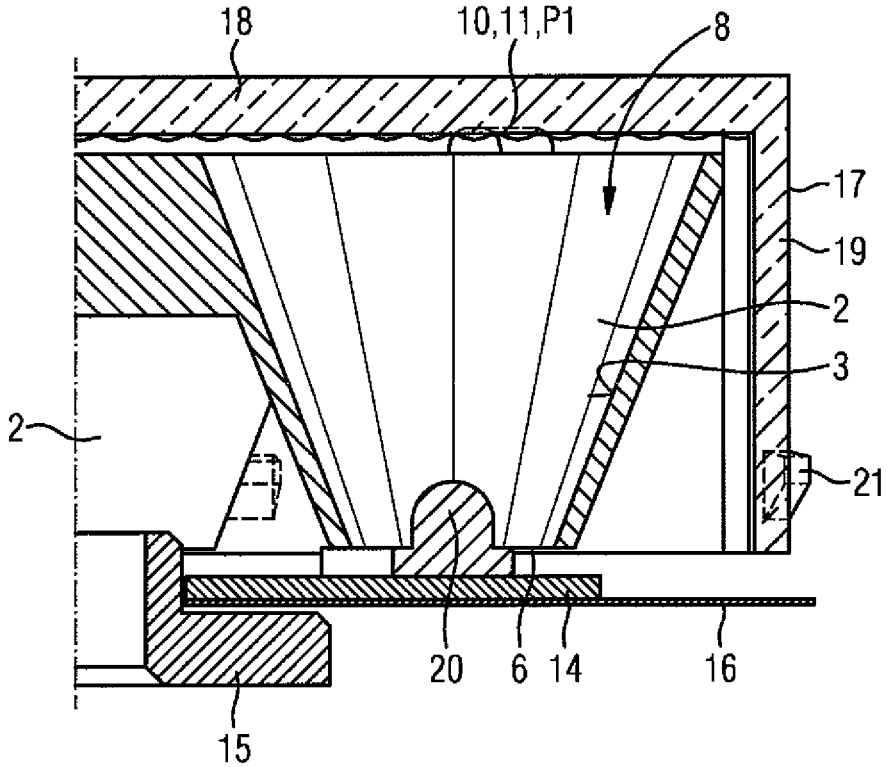
FIG. 4 shows a side view of yet another part of the lighting device having the reflector according to the first exemplary embodiment.

FIG. 4 shows a side view of yet another part of the lighting device 13 with the cover 17 in place, namely now through one of the reflector recesses 2. A light-emitting diode 20 which casts its light partly onto the inner side 3 of the reflector recess 2 and partly directly out through the reflector opening 8 projects through the rear cutout 6. The edge 19 of the cover 17 has at least one lug 21 by means of which the cover 17 can be locked in place on the housing 16.

Figure 5:
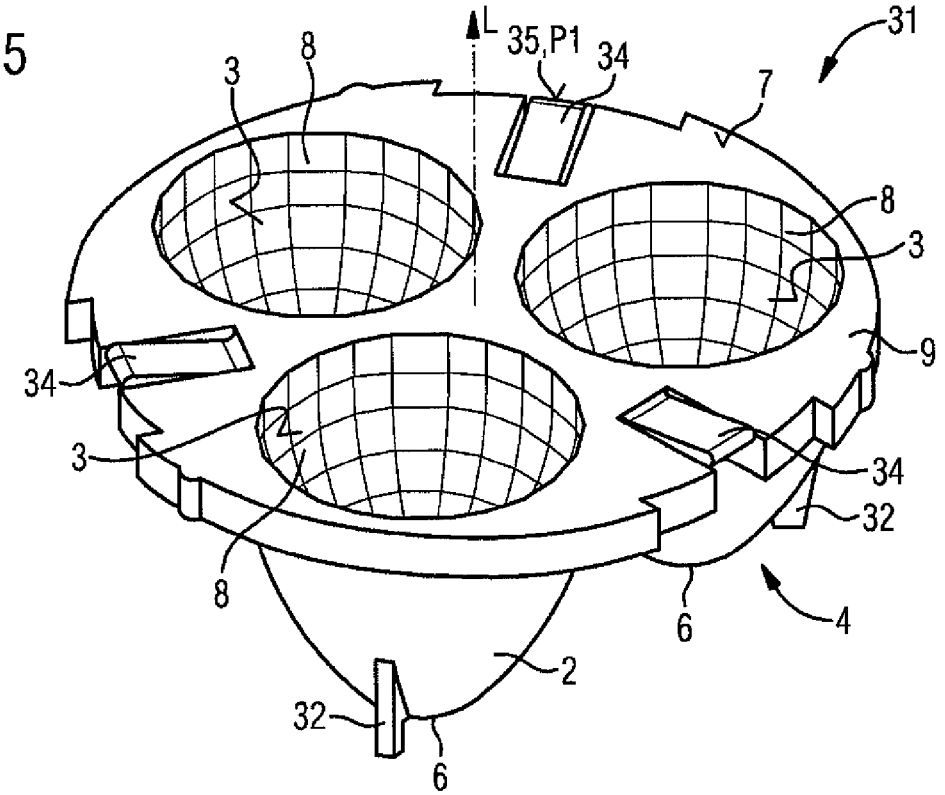
FIG. 5 shows an oblique top view of a reflector according to a second exemplary embodiment.
Figure 6:
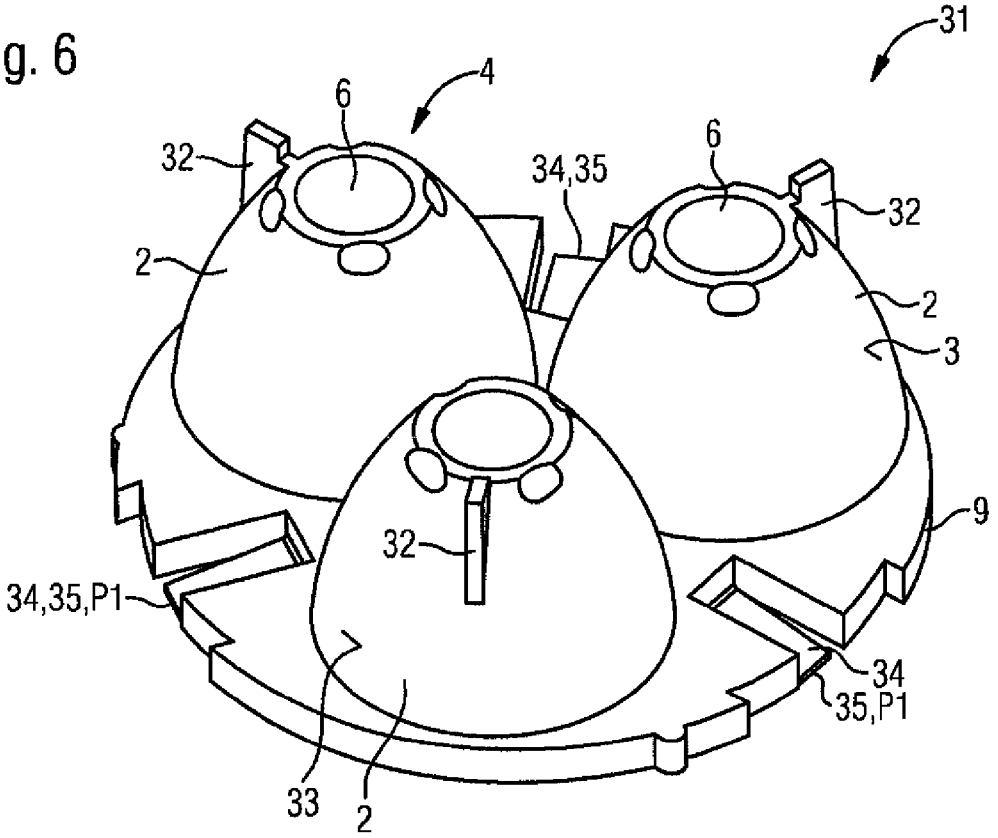
FIG. 6 shows an oblique bottom or rear view of the reflector according to the second exemplary embodiment.

FIG. 5 shows an oblique top view of a reflector 31 according to a second exemplary embodiment. FIG. 6 shows an oblique bottom view of the reflector 31. With reference to both FIG. 5 and FIG. 6, the reflector 31 is of similar design to the reflector 1 according to the first exemplary embodiment, but now only three reflector recesses 2 are present, the spacers 32 are molded to a respective outer side 33 of the reflector recesses 2, and three spring elements 34 disposed in an axially symmetric manner with respect to the longitudinal axis L are incorporated in the upper edge 9 of the reflector 31.

Each of the spring elements 34 is implemented as an obliquely forward or upward (in longitudinal direction L) oriented, unilaterally fixed bar. The free end 35 of the spring elements 34 constitutes the highest or farthest forward projecting point P1. If the cover 17 presses on the front side 7 of the reflector 31, it pivots the spring elements 34 elastically downward, thereby enabling the reflector 31 to be pressed onto the carrier plate, namely with compensation of manufacturing and assembly tolerances. The maximum tolerance can in particular correspond essentially to the amount of the projecting length of the free end 35, which constitutes the farthest forward projecting point P1, above the front side 7 of the reflector 31.

Here also the reflector 31 implemented in one piece as a plastic part.

Figure 7:
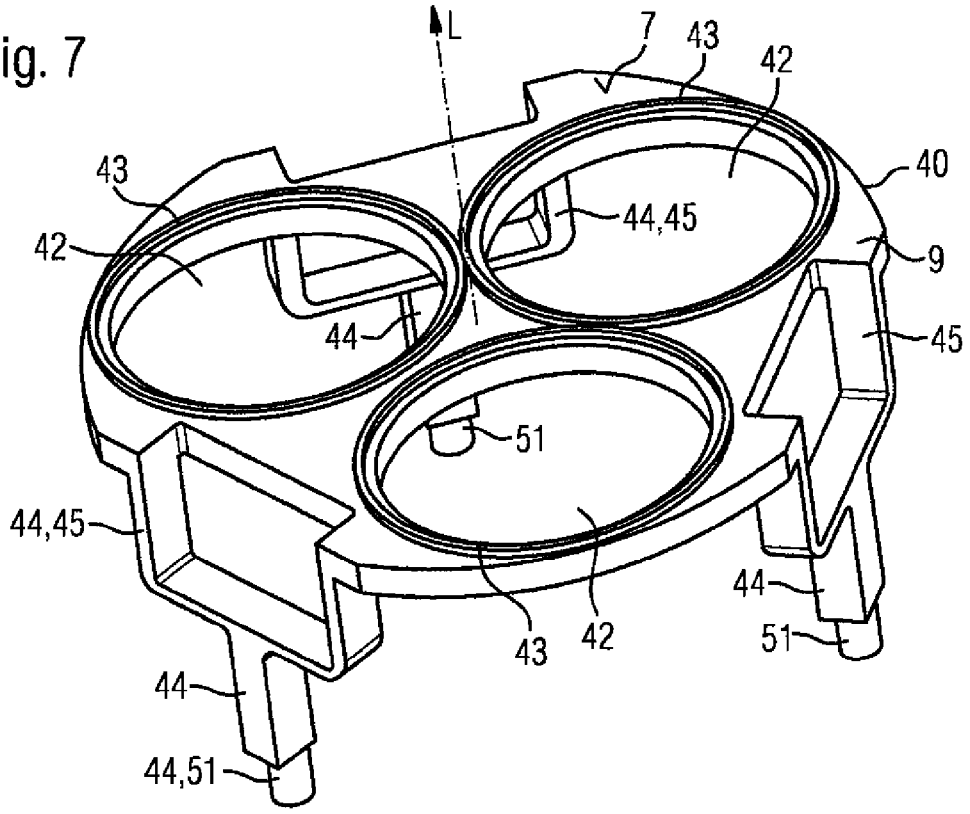
FIG. 7 shows an oblique top view of a reflector holder of a reflector according to a third exemplary embodiment.

FIG. 7 shows an oblique top view of a reflector holder 40 of a reflector 41 according to a third exemplary embodiment. The plastic reflector holder 40 has three insertion openings 42 for insertion of an aluminum reflector insert 46 (see other figures), wherein the reflector inserts 46 are seated on corresponding edges or annular grooves 43 and can be positioned therein. The reflector holder 40 here has three rearward oriented (aligned contrary to the longitudinal direction L) support elements 44 whose rear ends are implemented as retaining pins 51. Instead of a forward projecting spring element, there is incorporated in each of the support elements 44 a U-shaped spring element 45 which engages the upper edge 9 of the reflector holder 40. In the event of a load applied from the front to the surface 7 of the reflector holder 40, the spring element 45, which can rest by means of the support element 44 e.g. on a housing of a lighting device and/or an LED carrier, is elastically deformed and exerts a forward (in longitudinal direction L) directed counterforce which now pushes the reflector holder 40 forward.

Figure 8:
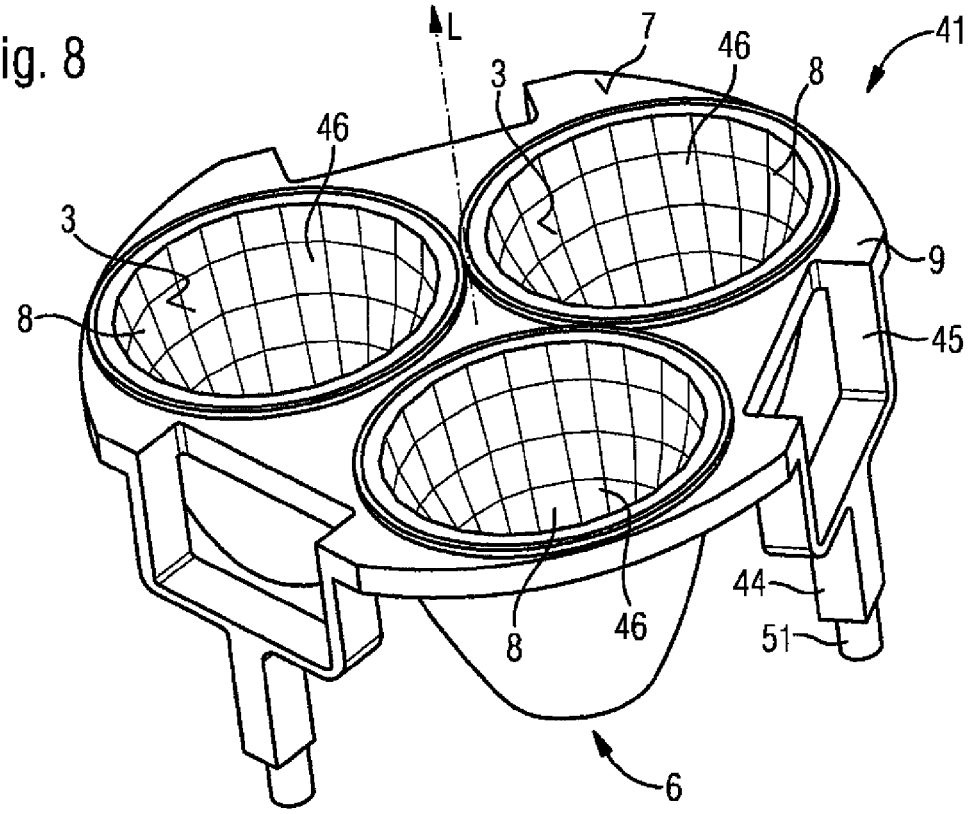
FIG. 8 shows an oblique top view of the reflector according to the third exemplary embodiment.
Figure 9:
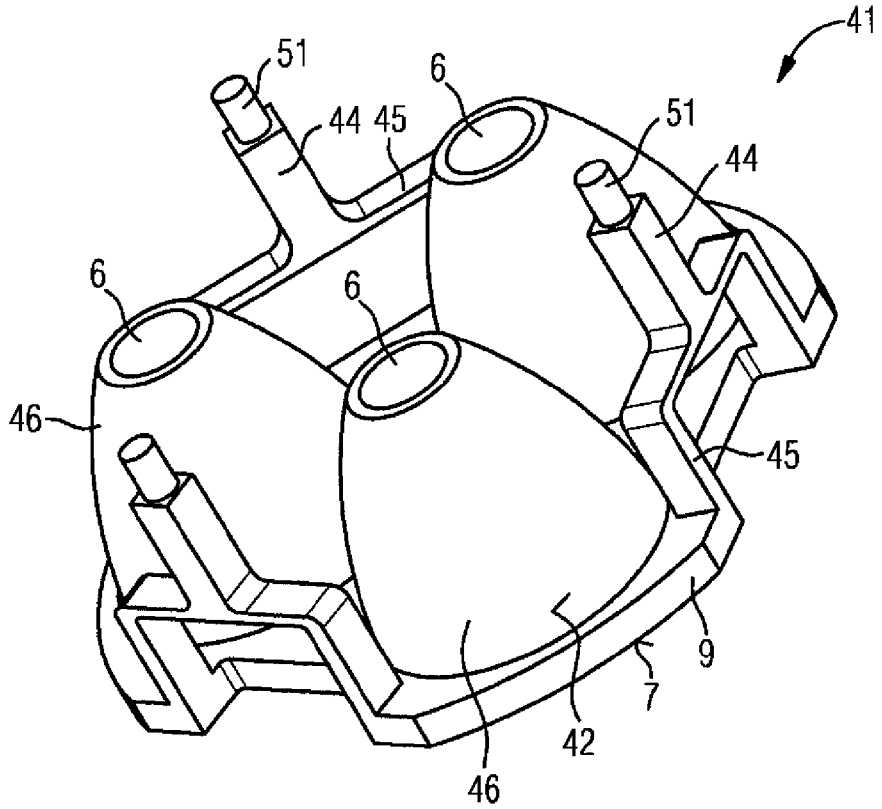
FIG. 9 shows an oblique bottom view of the reflector according to the third exemplary embodiment.

FIG. 8 shows an oblique top or front view and FIG. 9 shows an oblique bottom view of the reflector 41 according to the third exemplary embodiment, wherein a respective reflector insert 46 is now inserted into each of the insertion openings 42 from the front. The reflector insert 46 is seated on the associated annular groove 43. Unless further measures are taken, the reflector inserts 46 remain loose on the insertion openings 42. To fix them in place, the reflector inserts 46 can be pushed e.g. into the insertion openings 42, e.g. by a translucent cover (not shown).

Each of the reflector inserts 46 has a rear-side cutout 6 and a front-side reflector opening 8, the inner side 3 of the respective reflector insert 46 being of reflective design. The reflection behavior of the now four-piece reflector 41 is similar to that of the reflector 31 and will not therefore be described in further detail here.

Figure 10:
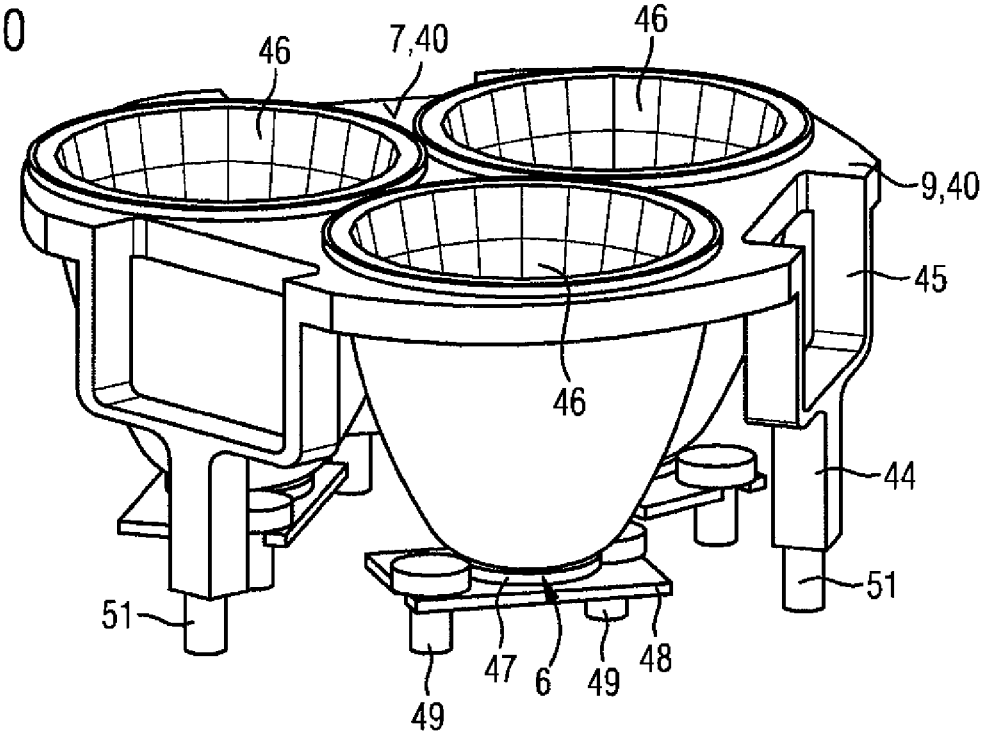
FIG. 10 shows an oblique top view of the reflector according to the third exemplary embodiment with associated light-emitting diodes.
Figure 11:
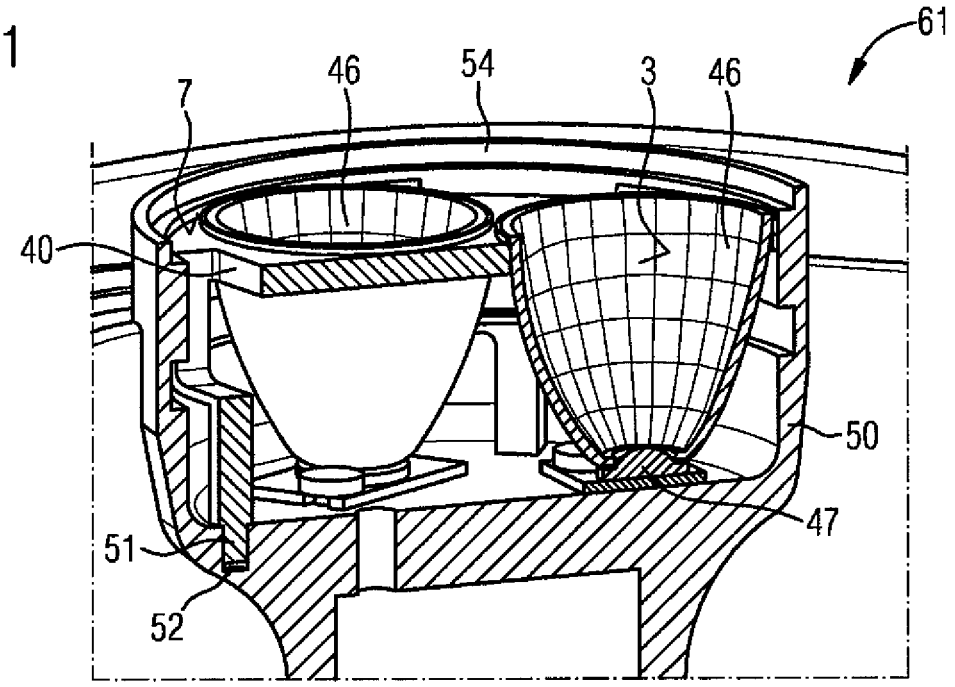
FIG. 11 shows a cross-sectional side view of another lighting device having the reflector according to the third exemplary embodiment.

FIG. 10 shows an oblique top view of the reflector 41 with associated light-emitting diodes 47. FIG. 11 shows a cross-sectional side view of a lighting device 61 having the reflector 41.

With reference to FIG. 10 and FIG. 11, the emitter surfaces of the light-emitting diodes 47 are inserted into the rear cutouts 6. The light-emitting diodes 47 are retained on respective LED carriers 48 which are in turn bolted to the housing with screws 49. The reflector 41 holds the reflector inserts 46 in a floating manner above the light-emitting diodes 47, i.e. the reflector 41 does not rest on the LED carriers 48, but the LED carriers 48 and the reflector 41 both rest on the common housing 50 which is here locally implemented as a heat sink.

For this purpose the reflector 41 is inserted by its retaining pins 51 into corresponding holes 52 drilled in the housing 50.

Figure 12:
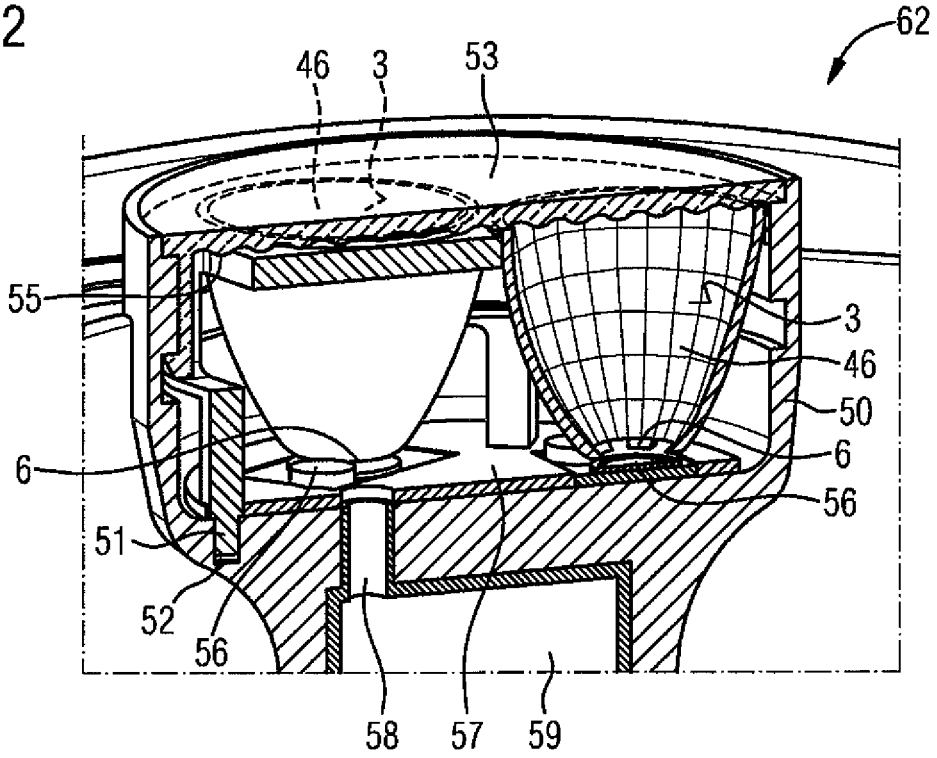
FIG. 12 shows a cross-sectional side view of yet another lighting device having the reflector according to the third exemplary embodiment.

To fix the reflector 41 in place, it is covered from the front by means of a circular disk-shaped translucent cover (not shown), e.g. similar to a cover 53 from FIG. 12. The cover can be inserted into a circumferential annular groove 54 of the housing and fastened there. The cover presses from above onto the upper edges of the reflector inserts 46 which project slightly above the surface 7 of the reflector holder 40. The spring elements 45 of the reflector holder 40 are thus pressed together and the reflector inserts 46 remain in pressure contact with the cover, causing it to be pushed into the insertion openings 42 and fixed there. A travel of the spring elements 45 can ensure tolerance compensation.

FIG. 12 shows a cross-sectional side view of yet another lighting device 62 having the reflector 41. The reflector 41 is covered by the cover 53 and pressed into the housing 50. The cover 53 is essentially circular disk shaped and has a Fresnel pattern 55 on its underside.

In contrast to the lighting device 61, the light-emitting diodes 56 are now mounted on a common, essentially circular LED carrier 57 (circuit board or similar) and do not extend into the associated rear cutout 6. The light-emitting diodes 56 rather radiate most of the light emitted by them, in particular essentially all the light emitted by them, through the respective cutout 6.

A cable bushing 58 which connects the wired front side of the LED carrier 57 to a receptacle cavity 59 for a driver runs through the housing 50 and the LED carrier 57. The part of the housing 50 visible here is essentially also implemented as a heat sink.

The present invention is of course not limited to the exemplary embodiments shown.

For example, the reflector according to the third exemplary embodiment can also be of one-piece design, e.g. plastic.

The inner sides of the reflector recesses can also merge and form a common reflector inner side which is illuminated by means of a plurality of cutouts.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A reflector for a plurality of lighting devices, comprising:

a reflector holder having a plurality of conical-shaped reflective surfaces disposed in an axially symmetric manner about a longitudinal axis, each conical-shaped reflective surface having a front-side reflector opening at a wider end of the conical-shaped reflective surface, and a rear cutout at a narrower end of the conical-shaped reflective surface, the rear cutout shaped for mounting one of the plurality of lighting devices therein so that light from the lighting device radiates directly or indirectly toward the front-side reflector opening, the reflector holder having a front-side surface in which the front-side reflector openings are positioned;

a covering element configured to cover the front-side surface of the reflector holder so that the plurality of front-side reflector openings are covered by the covering element;

a light source carrier onto which each of the plurality of lighting devices is mountable;

a housing;

at least one elastic spring element integrally formed along a circumferential periphery of an upper edge of the reflector holder, the upper edge being at a front side of the reflector holder where light radiates from the plurality of conical-shaped reflective surfaces through the plurality of front-side reflector openings, each spring element having a shape of a connected double U with each U being positioned alongside another U with the openings of the connected double U directed toward the upper edge of the reflector and a width of the connected double U being oriented to extend partially around the circumferential periphery of the upper edge of the reflector holder; and a locking mechanism, wherein the covering element is disposed on the reflector holder, the reflector holder is disposed on the light source carrier, and the light source carrier is disposed on the housing so as to form an enclosed space delimited by the covering element and the housing, wherein each spring element is configured so that a portion of each spring element projects forward beyond the front-side surface of the reflector holder so that each spring element presses against the covering element, and wherein the locking mechanism in configured to lock the covering element to the housing.

2. The reflector of claim 1, wherein the reflector holder is of at least two-piece design with the plurality of conical-shaped reflective surfaces being separate inserts mounted into the reflector holder.

3. The reflector of claim 1, wherein the reflector holder is of one-piece design with the plurality of conical-shaped reflective surfaces being formed into the reflector holder.

4. The reflector of claim 1, wherein the reflector holder has at least one rearward projecting spacer seated on the light source carrier.

5. A reflector for a plurality of lighting devices, comprising:

a reflector holder having a plurality of conical-shaped reflective surfaces disposed in an axially symmetric manner about a longitudinal axis, each conical-shaped reflective surface having a front-side reflector opening at a wider end of the conical-shaped reflective surface, and a rear cutout at a narrower end of the conical-shaped reflective surface, the rear cutout shaped for mounting one of the plurality of lighting devices therein so that light from the lighting device radiates directly or indirectly toward the front-side reflector opening, the reflector holder having a front-side surface in which the front-side reflector openings are positioned;

a covering element configured to cover the front-side surface of the reflector holder so that the plurality of front-side reflector openings are covered by the covering element;

a light source carrier onto which each of the plurality of lighting devices is mountable;

a housing;

at least one elastic spring element integrally formed along a circumferential periphery of an upper edge of the reflector holder and extending radially outward from the longitudinal axis, the upper edge being at a front side of the reflector holder where light radiates from the plurality of conical-shaped reflective surfaces through the plurality of front-side reflector openings, each spring element comprising an obliquely forward facing, unilaterally fixed bar, a portion of each spring element projecting forward beyond and through the front-side surface of the reflector holder; and a locking mechanism, wherein the covering element is disposed on the reflector holder, the reflector holder is disposed on the light source carrier, and the light source carrier is disposed on the housing so as to form an enclosed space delimited by the covering element and the housing, wherein each spring element is configured so that each spring element presses against the covering element, and wherein the locking mechanism is configured to lock the covering element to the housing.

6. A reflector for a plurality of lighting devices, comprising:

a reflector holder having a plurality of conical-shaped reflective surfaces disposed in an axially symmetric manner about a longitudinal axis, each conical-shaped reflective surface having a front-side reflector opening at a wider end of the conical-shaped reflective surface, and a rear cutout at a narrower end of the conical-shaped reflective surface, the rear cutout shaped for mounting one of the plurality of lighting devices therein so that light from the lighting device radiates directly or indirectly toward the front-side reflector opening, the reflector holder having a front-side surface in which the front-side reflector openings are positioned;

a covering element configured to cover the front-side surface of the reflector holder so that the plurality of front-side reflector openings are covered by the covering element;

a light source carrier onto which each of the plurality of lighting devices is mountable;

a housing;

at least one elastic spring element integrally formed along a circumferential periphery of an upper edge of the reflector holder, the upper edge being at the front-side surface of the reflector holder where light radiates from the plurality of conical-shaped reflective surfaces through the plurality of front-side reflector openings, each spring element having a shape of a single U with an opening of the U directed toward the upper edge of the reflector and a width of each U being oriented to extend partially around the circumferential periphery of the upper edge of the reflector holder; and a locking mechanism, wherein the covering element is disposed on the reflector holder, the reflector holder is disposed on the light source carrier, and the light source carrier is disposed on the housing so as to form an enclosed space delimited by the covering element and the housing, wherein each spring element is configured so that each spring element causes the reflector holder to press against the covering element, and wherein the locking mechanism is configured to lock the covering element to the housing.

7. The reflector of claim 6, wherein the reflector holder has a support element and each spring element is incorporated into a respective support element of the reflector, and wherein the respective support element is disposed on the housing.

* * * * *